US005685457A

United States Patent [19]

Liberatore

[11] Patent Number: 5,685,457

[45] Date of Patent: Nov. 11, 1997

[54] SNAPPED TOGETHER TUBE AND DISPENSING APPARATUS AND METHOD OF MAKING SAME

[76] Inventor: Raymond A. Liberatore, 11931 Elmrock Ave., Whittier, Calif. 90604

[21] Appl. No.: 638,532

[22] Filed: Apr. 26, 1996

Related U.S. Application Data

[63] Continuation-in-part of Ser. No. 614,624, Mar. 13, 1996.

[51] Int. Cl.[6] ..... B65D 35/34

[52] U.S. Cl. ..... 222/100

[58] Field of Search ..... 222/98, 99, 100

[56] References Cited

U.S. PATENT DOCUMENTS

| | | | |
|---|---|---|---|
| 955,530 | 4/1910 | Morrison . | |
| 1,692,213 | 11/1928 | Kielberg . | |
| 1,770,946 | 7/1930 | Rostiser . | |
| 1,797,727 | 3/1931 | La Spisa . | |
| 1,986,409 | 1/1935 | Redmer . | |
| 2,531,060 | 11/1950 | Krueger . | |
| 2,545,773 | 3/1951 | Gonzalez . | |
| 2,851,195 | 9/1958 | Widmann . | |
| 2,879,531 | 3/1959 | Hopkins | 222/99 |
| 2,896,822 | 7/1959 | Songer | 222/99 |
| 3,473,698 | 10/1969 | Ballin . | |
| 3,885,708 | 5/1975 | Parry . | |
| 3,920,157 | 11/1975 | Yeung . | |
| 4,570,828 | 2/1986 | Wood . | |
| 4,576,314 | 3/1986 | Elias et al. . | |
| 4,653,670 | 3/1987 | Kendrick . | |
| 4,664,293 | 5/1987 | Sheppard . | |
| 5,097,987 | 3/1992 | Liberatore . | |
| 5,215,223 | 6/1993 | Lee | 222/99 |

FOREIGN PATENT DOCUMENTS

| | | |
|---|---|---|
| 798687 | 5/1936 | France . |
| 125349 | 4/1928 | Germany . |
| 238430 | 10/1945 | Switzerland . |
| 370204 | 4/1932 | United Kingdom . |

*Primary Examiner*—Philippe Derakshani
*Attorney, Agent, or Firm*—Fulwider Patton Lee & Utecht, LLP

[57] ABSTRACT

A tube of flowable material closed at one end and formed with a clasp projectable through a slit in a cylindrical housing to engage one or more deflectable teeth in a slot formed in a reel carried from such housing. The clasp is then engaged behind the teeth to thereby be latched in position on the reel for winding on such reel to draw the tube successively through the slit as the reel is rotated.

14 Claims, 4 Drawing Sheets

FIG. 1
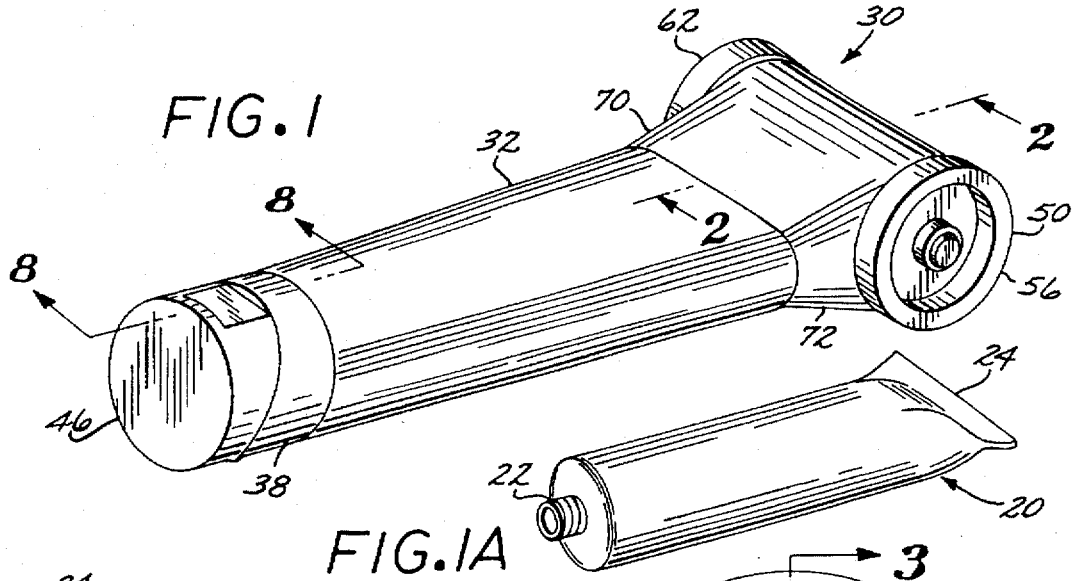
FIG. 1A
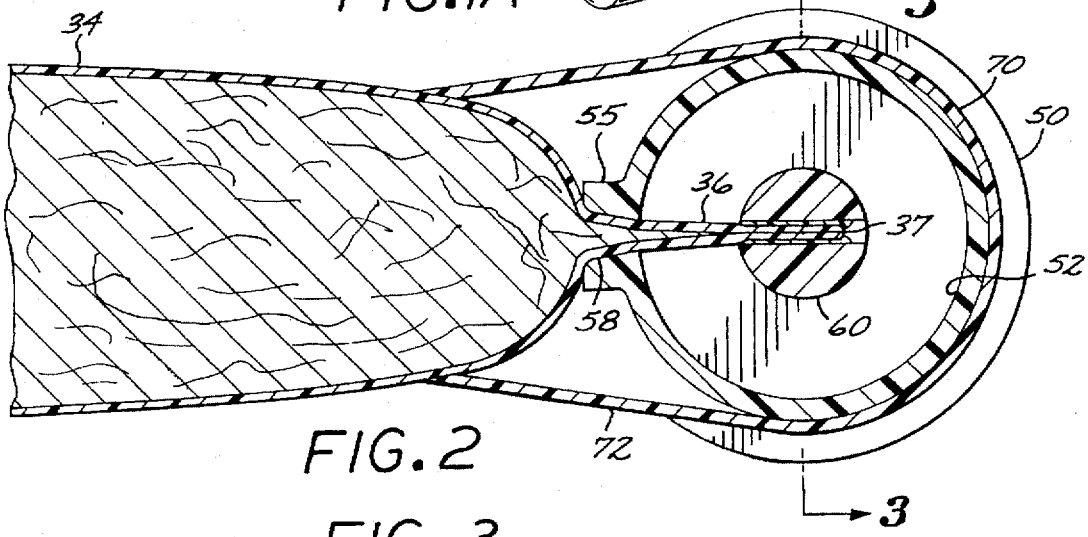
FIG. 2
FIG. 3
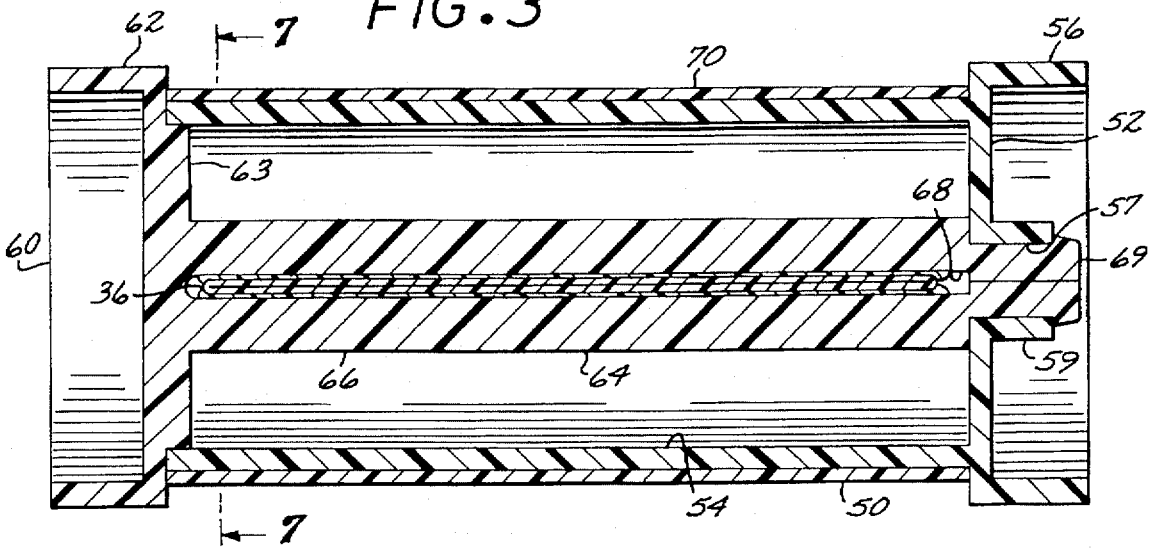

SNAPPED TOGETHER TUBE AND DISPENSING APPARATUS AND METHOD OF MAKING SAME

This is a continuation-in-part of application Ser. No. 08/614,624 pending filed on Mar. 13, 1996.

BACKGROUND OF THE INVENTION

1. Field of the Invention

The invention relates to flexible tubes for selectively dispensing storable contents, and more particularly a collapsible container snapped permanently into a reel and a method of making same.

2. Description of the Prior Art

Consumers often prefer flexible dispensing containers over other forms of product packaging, because such tubes are relatively clean and manually squeezable to controllably expel small amounts of the stored product outwardly through an orifice or nozzle. Manual manipulation of a conventional collapsible tube by, for example, squeezing the tube wall, generally results in a random movement of the stored contents. The movement is a forced reaction to the compression of the tube walls caused by the manually squeezing. While a relatively full tube readily expels sufficient mounts of product in response to such manipulation, a relatively empty tube often expels little or no product from the nozzle, instead urging the contents into an empty portion of the tube. Those endeavoring to use each and every ounce of the product often resort to finding a flat edged apparatus to forcefully flatten the tube from the rear end towards the tube nozzle, thereby urging the contents in one direction only, and ultimately out the tube. Because of the added difficulty in dispensing product from a relatively empty tube, the average consumer typically disposes of it as refuse.

Premature disposal of consumer product packaging is believed to contribute greatly to the rapid filling of available landfills. Collapsible tubes in particular, often contain a measurable percentage of the original product when disposed. Use of the typically wasted product by consumers would thus have a substantial impact on the environment through the conservation of available landfill space.

One proposal to the above problems involves attaching a narrow elongated rod to the crimped end of a conventional metallic tube. The rod is formed at one end with a manually turnable key shaped handle for rotating the rod. To urge the contents unidirectionally out the tube nozzle, the user rotates the key thereby winding the empty tube around the rod and causing the walls of the tube to pinch together. Such pinching displaces the contents towards the nozzle end of the tube. Variations of such a construction are disclosed in U.S. Pat. Nos. 955,530, 1,770,946, 1,986,409, 2,545,773, 2,838,207, and 2,873,888. While such a proposal is beneficial for use with metallic tube constructions, laminated vinyl or co-extruded plastic constructions typically tend to unwind due to the restorative properties inherent in such materials.

A more recent proposal is disclosed in U.S. Pat. No. 5,097,987, issued to the applicant of the present application. The patent discloses a dispenser having a housing and a rotatable reel for winding the crimped end of the tube. The reel is slotted for telescopically receiving the tube end such that the tube may be slidably disengaged from the reel upon emptying of the tube contents. While the invention is beneficial for its intended purposes, the reel does not provide a convenient arrangement for non-releasable attachment on the crimped end of the tube.

Attempts at constructing collapsible tubes with permanently attached dispensers have been disclosed in connection with single piece devices. One such apparatus is proposed in U.S. Pat. No. 4,316,556 that includes an oval shaped body having an engagement flange formed with a narrow slot for telescopically receiving the end of the tube. As the body slides along the tube, the engagement flange compresses oppositely disposed walls of the tube together, urging the contents toward the tube nozzle. The body is permanently attached to the crimped end of the tube with rivet like fasteners. While this proposal is beneficial for its intended uses, no mechanical means are disclosed for incrementally advancing the engagement flange controllably along the tube and confining the unsightly emptied portion of the tube from view.

The dispenser apparatus shown in my copending parent application, U.S. Ser. No. 08/614,624, filed Mar. 13, 1996, discloses a number of different embodiments of dispenser devices which afford satisfactory results. However, another embodiment originated by me provides for a reel and housing construction which conveniently and quickly snaps directly to the closed end of a toothpaste tube for permanent connection thereto.

SUMMARY OF THE INVENTION

A collapsible tube of flowable material formed with a closed end configured with a catch. The closed end projects through a laterally projecting narrowed compressing slit formed in a cylindrical housing and lockingly engages behind a flexible tooth or teeth included in a laterally projecting diametrical slot in such reel to lock such closed end to the reel.

The tube and dispenser may be conveniently manufactured by forming the tube with a reduced-in-cross section, tapered closed end configured with a clasp having a clasp surface facing in the direction of the body of the tube. The closed end may be thus inserted through the slit toward the slot in the reel and pressed sufficiently far into such slot to flex the tooth aside for receipt of the clasp behind the tooth to allow the tooth to flex back to its normal position and lock the clasp in position.

Other features and advantages of the invention will become apparent from the following detailed description, taken in conjunction with the accompanying drawings, which illustrate, by way of example, the features of the invention.

BRIEF DESCRIPTION OF THE DRAWINGS

FIG. 1 is a perspective view of an embodiment of the tube and dispenser apparatus of the present invention;

FIG. 1A is a reduced perspective view of a filled collapsible tube for use in an embodiment of the present invention;

FIG. 2 is an enlarged partial longitudinal cross-sectional view taken along lines 2—2 of FIG. 1;

FIG. 3 is a lateral cross sectional view taken along lines 3—3 of FIG. 2;

DETAILED DESCRIPTION OF A PREFERRED EMBODIMENT

Figure 4:
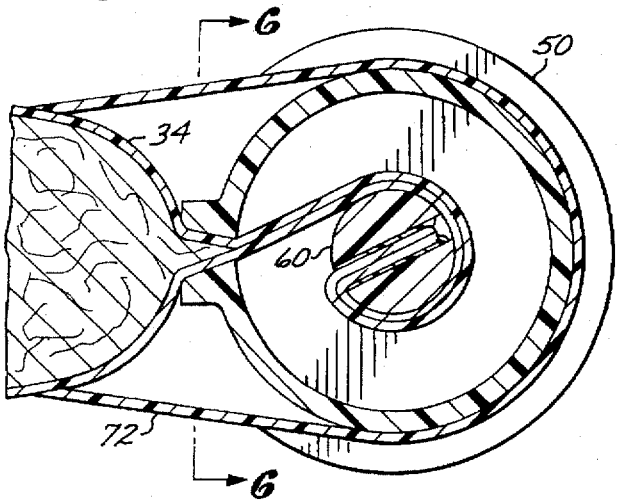
FIG. 4 is a partial longitudinal cross-sectional view similar to FIG. 2 but shown during a different stage of operation.

Collapsible containers or tubes are recognized as a convenient and economical means of storing and dispensing products such as toothpaste, lotions and gels. Typically, such conventional containers, shown in FIG. 1A and generally designated 20, are formed from metal, vinyl or plastic into elongated tubular structures to facilitate easy manipulation by hand. The tubes are generally flexible and include a capped dispensing nozzle 22 to regulate the outward flow of the product, and a crimped closure 24 disposed opposite the nozzle at the rearward extremity of the tube. Under conventional manufacturing methods, the contents of the tube are introduced into the tube from the rear end opposite the capped nozzle due to the relatively large opening available. Following fill, the tube manufacturer seals the nozzle with a cap or other sealing structure and crimps the rear end closed.

The flexible nature of a collapsible tube serves as an inherent dispensing mechanism for expelling the tube contents through the tube nozzle. A manual compression of the tube wall forces a displacement of the inner contents away from the compression point. For relatively full containers, such displacement results in a quantity of the desired contents escaping outwardly from the nozzle. However, for relatively empty containers, a random squeeze of the tube often merely displaces material into an unoccupied area of the tube. Typically, once this state occurs, the average consumer often disposes of the tube, leaving a measurable portion of the contents unused.

Conventional tube dispensers provide a means for enabling consumers to incrementally control the flow of material from a tube and enable the use of substantially all of the available contents. Rotatable reel type dispensers typically include an elongated spindle formed with a slot to allow releasable engagement with the closed end of a conventional tube. However, in order for the reel to securely grasp the tube, a sufficient amount of the tube must be manually flattened, inserted through the slot, then partially wound around the reel. While such a device is satisfactory for use with consumers, the effort to prepare the closed end for winding around the reel discourages mass assembly of such dispensers to collapsible tubes.

Referring to FIG. 1, a first embodiment of the tube and dispensing apparatus of the present invention, generally designated 30, solves the aforementioned problems by providing a conventional collapsible tube 32 filled with a flowable material and permanently attached to a mechanically incremental dispenser apparatus 50, for selectively controlling the dispensing of the tube contents.

Figure 8:
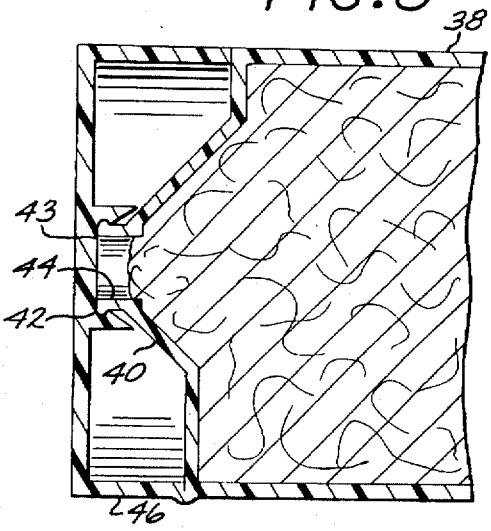
FIG. 8 is an enlarged partial longitudinal cross-sectional view taken along lines 8—8 of FIG. 1.

With reference to FIGS. 1, 2 and 8, the tube body 32 is formed from a sheet of thin metal, laminated vinyl or plastic to define a flexible peripheral tube wall 34 and includes a flattened closed end 36 and a selectively openable dispensing end 38. Typically, the tube wall longitudinally overlaps on itself to form a marginal seam (not shown) that enables manufacturers to economically form the tube from a single sheet of material. The dispensing end of the tube terminates in a generally frusto-conical shoulder 40 (FIG. 8) with an outwardly projecting neck 42. The neck terminates in a nozzle 43 and is formed with a through passage 44 that continues through the shoulder to fluidly communicate with the interior of the tube. Typically, the passage is orificed to a reduced-in-diameter size to regulate the flow of contents being expelled from the tube as a result of manual squeezing or the like. A cap 46 complementarily formed to cover and seal the nozzle detachably engages the neck to form a seal and preserve the quality of the contents. While a snap-on type cap is shown in FIG. 1 for illustrative purposes, it is envisioned that any type of cap structure capable of sealably engaging the nozzle may be used, such as that shown in FIG. 10. The closed end 36 (FIG. 2) of the tube is disposed opposite the dispensing end 38 and is generally crimped at 37 to form a flattened attachment surface.

Figure 6:
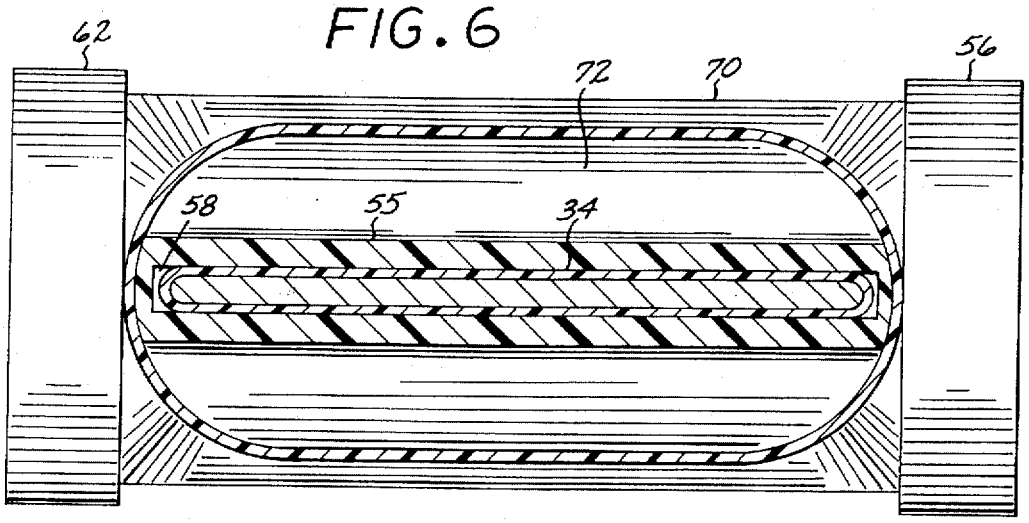
FIG. 6 is a lateral cross-sectional view taken along lines 6—6 of FIG. 4.

Referring to FIGS. 2, 3 and 6 the dispenser apparatus 50 includes, generally, a cylindrical housing 52 substantially surrounding a rotatable reel 60. The housing is preferably molded or extruded from a plastic material and formed with a transversely elongated cylindrical barrel 54. The barrel is configured at one end with a hand grip wheel 56 formed with a throughbore 57 and bounded by an outwardly projecting annular flange 59. The barrel is open at its opposite end. One side of the barrel is formed with an oval flange 55 formed with a narrow compression slit 58 for progressively receiving the tube body 32 to progressively compress the opposite lateral side of the peripheral tube wall 34.

With further reference to FIGS. 2 and 3, the reel 60 is preferably formed at one end with a rotatable wheel 62 for overlying the open end of the housing. A transversely elongated spool 64 projects inwardly from the wheel and concentrically through the barrel 54. The spool is formed with a split shaft to form a pair of coextensive tines 66 cooperating to form therebetween a slit 68 for receiving the closed end 36 of the tube. The tines cooperate further at a common distal end to form an anchor shaped fastener for axially engaging the housing wheel bore 57. The anchor allows the housing to be permanently attached to the reel during assembly.

Figure 7:
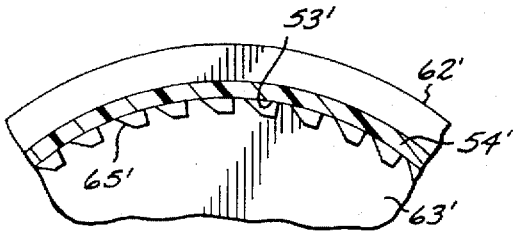
FIG. 7 is a slightly enlarged, partial longitudinal cross-sectional view similar to FIG. 4, but showing an alternative reel and housing construction.

In an alternative embodiment of the housing and the reel, shown in FIG. 7, the housing may include a cylindrical wall 54' formed with an inwardly radially suspended pawl 53'. In such an embodiment, the reel includes a rotatable wheel 62' formed on its inner edge with a gear 63' having a peripheral edge formed with a plurality of modified sawtooth shaped teeth 65' for releasably engaging the pawl 53'. Such a configuration provides a ratchet type device to lock against unreeling.

Referring to FIGS. 1 and 2, the tube and dispenser apparatus 30 optionally includes a formed shroud 70 typically formed integral with the reel housing but shown here for illustrative purposes as wrapped around the distal side of the housing barrel 54. The shroud projects longitudinally from the housing toward the tube body 32 a predetermined distance to form a peripheral wall 72 around the tube. In practice, the integrally formed housing and shroud may be configured as a rearwardly hinged clam-shell shaped structure, or fabricated as a multi-piece snap-together construction to surround the reel spool 64.

Figure 14:
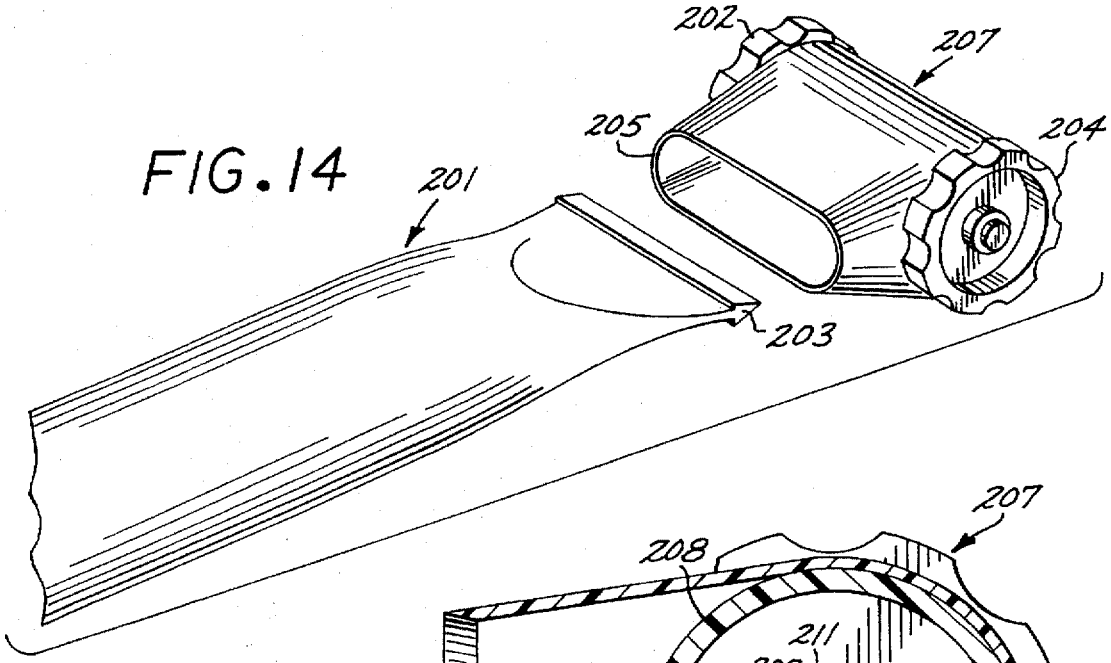
FIG. 14 is a perspective view of another embodiment of the tube and dispenser apparatus of the present invention.

Manufacturers of collapsible tubes may construct the first embodiment of the tube and dispenser apparatus of the present invention pursuant to the following method. With reference to FIG. 14, the method includes a first step 80 of selecting a collapsible tube having a flexible peripheral wall capable of being compressed and expanded and having a selectively openable dispensing end and an open filling end. The tube is then filled, at step 82, with a flowable material typically urging the tube wall laterally outwardly. The filling end of the tube is then closed, at step 84, as by heat bonding or mechanical crimping. The method continues at step 86 by selecting a dispensing device 50 including a housing 52 and reel 60 as described above. The closed end of the tube, at step 88, is then anchored non-releasably to the reel by compressing the end between the reel tines 66. The housing 52 is then permanently enclosed around the reel 60, at step 90, such that the compression slit 58 telescopically receives and compressingly engages the tube wall 34.

Referring to FIGS. 5, and 9–13, a second embodiment of the present invention, generally designated 100, allows manufacturers to fill a collapsible tube 102 with flowable material after permanently attaching a dispenser apparatus 130. The tube includes an elongated flexible tube body 104 formed with an expandable peripheral wall initially compressed into a laterally substantially flattened orientation. The body terminates in a closed end 107 and an oppositely disposed dispensing end 108 formed with an outwardly opening oversized-in-diameter mouth 110. The mouth defines an inwardly projecting cylindrical wall 112 having internal threads to form a first locking portion.

Figure 9:
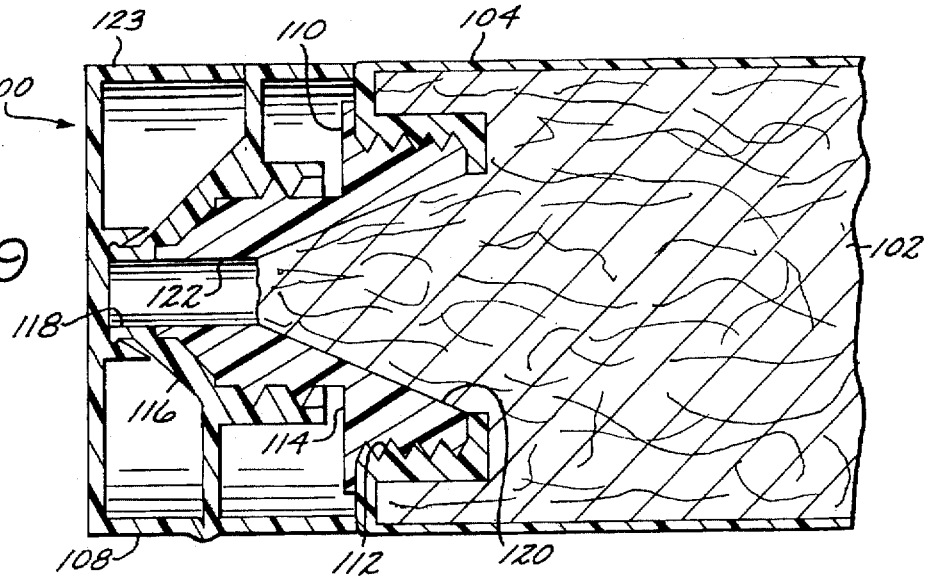
FIG. 9 is a view similar to FIG. 8, but showing an alternative shoulder and cap structure.
Figure 10:
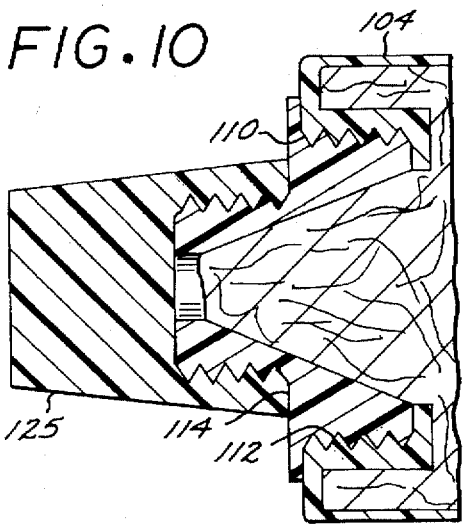
FIG. 10 is a view similar to FIG. 9, but showing an alternative cap structure.

With further reference to FIG. 9, the dispensing end 108 further includes a nozzle adapter 114 for sealably attaching to the threaded mouth 110. The front of the adapter is shaped with an axially projecting reduced-in-diameter neck 116 and formed with an outwardly opening orifice to define a nozzle 118. The rear of the adapter is formed with an axial fitting 120 configured with external threads to form a second locking portion to sealably engage the mouth cylindrical wall 114. The nozzle adapter 114 is further formed with a through-passage 122 for establishing fluid communication between the mouth and the nozzle. The dispensing end terminates in a cap device 123 for sealably closing the nozzle 118. The cap device may take one of several configurations such as a snap-on type construction (FIG. 9), or a threaded screw-on construction 125 (FIG. 10).

Figure 5:
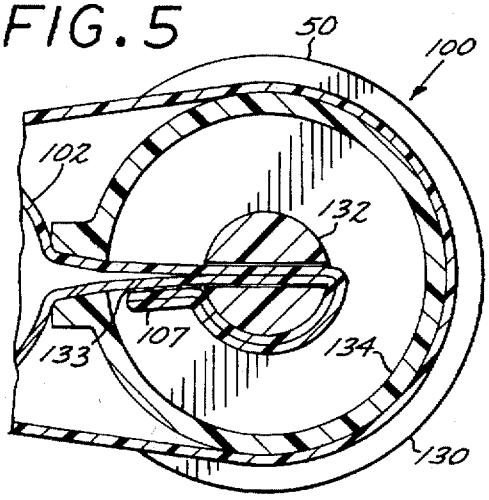
FIG. 5 is a view similar to FIG. 4, but illustrating an alternative attachment configuration.

Referring to FIG. 5, the second embodiment of the present invention further includes a dispenser apparatus 130 substantially similar to the dispenser 50 disclosed in the first embodiment of the present invention and having a rotatable reel 132 disposed within a cylindrical housing 134. However, because the dispenser 130 may be attached to the tube body 102 prior to filling, different techniques for non-releasably attaching the closed end 107 to the reel may be used. As shown in FIG. 5, the tube may be inserted through the reel and doubled back on itself to be heat bonded at 133, or attached in the manner disclosed in the first embodiment. It is intended that many forms of rotatable reels and housings may be implemented in the present invention to carry out the permanent attachment function of the dispenser to the tube.

Figure 11:
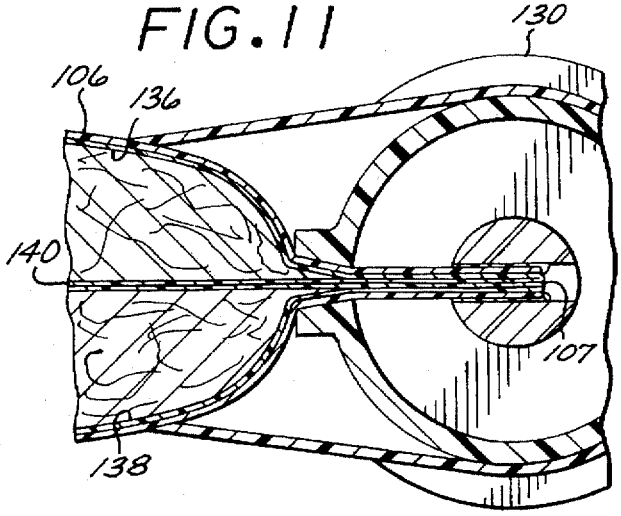
FIG. 11 is a view similar to FIG. 2, but showing an alternative tube structure.
Figure 12:
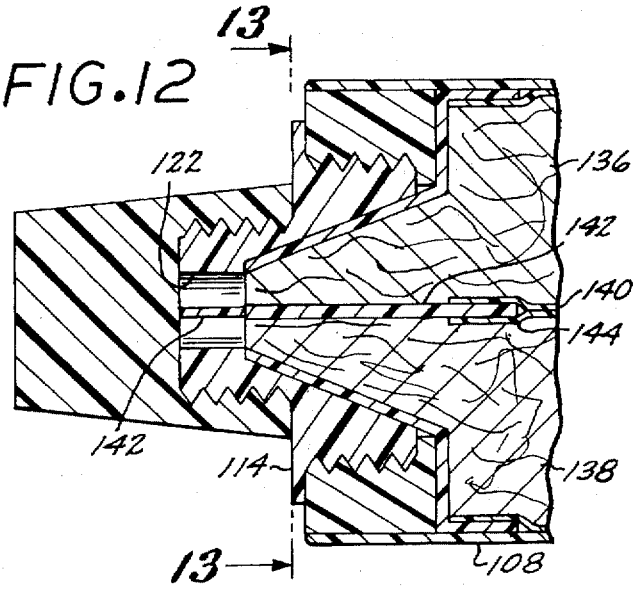
FIG. 12 is a view similar to FIG. 10, but showing an alternative shoulder and cap structure for use with the tube structure shown in FIG. 11.
Figure 13:
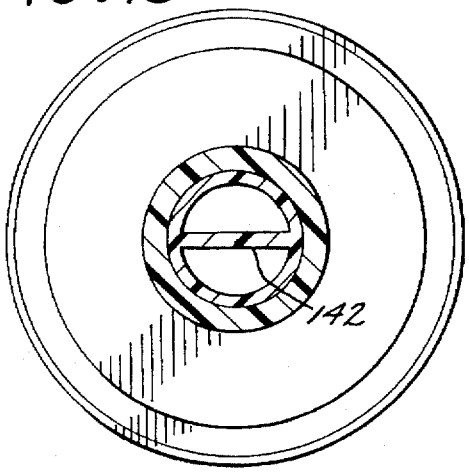
FIG. 13 is a lateral cross-sectional view taken along lines 13—13 of FIG. 12.

An optional configuration for the tube construction, shown in FIGS. 11, 12, and 13 may be used with both embodiments of the present invention and involves the partitioning of the tube interior to create at least two separate compartments 136 and 138. This may be accomplished by forming the tube with a continuous longitudinal partition 140 extending from the closed end 107 of the tube to the dispensing end 108. Such a partition prevents ingredients from mixing inside the tube which is believed to cause degradation of the quality of the ingredients. At the dispensing end, the nozzle adapter 114 includes a nozzle separator 142 axially inserted within the throughpassage 122 and connected in longitudinal engagement at 144 with the partition 140.

Another tube construction (not shown) envisioned for use with both of the aforementioned embodiments includes a tube wall formed into a low profile oval configuration. This design tends to minimize interference between the tube shoulder and the housing oval flange when the tube is substantially emptied of its contents. This is because an associated shoulder will also be of low profile as contrasted to generally over-sized conically formed shoulders, and will be formed to complementarily engage the housing oval flange. As a result, it is believed that an additional amount of product may be accessible within the tube.

In operation, the collapsible container of the present invention provides consumers with a pre-fabricated collapsible tube attached to a disposable dispensing apparatus. One endeavoring to dispense an anticipated quantity of flowable material from the container will typically squeeze the tube at the closed extremity in normal fashion to eject the desired quantity of product from the neck. As the stored product at the closed extremity becomes depleted, the user may grasp the housing wheel 56 to hold the housing while rotating the reel wheel 62 an incremental amount. Such rotation correspondingly rams the reel 66 creating a winding action of the anchored tube around the reel and drawing the tube incrementally through the compression slit 58. As the tube advances through such compression slit, the opposing walls of the tube are pinched into a flattened state to feed the flattened structure onto the reel. The emptied portion of the tube will thus be wound in a coil around the reel 66 to be stored. This process may then be repeated as the content of the tube is further depleted with further use.

Incorporation of the optional ratchet construction on the reel wheel 62' and the housing wall 54' provides a convenient means of preventing the tube body 32 from unreeling from the reel. As the reel wheel 62' is rotated a predetermined direction, the tapered leading edges of the modified sawtooth shaped teeth 65' (FIG. 7) releasably engage the pawl 53. Once rotation ceases, should the reeled tube body tend to unreel, the radially projecting trailing edge of the last advancing tooth engages the pawl thereby inhibiting reverse rotation of the reel and preventing unfeeling of the tube.

Figure 15:
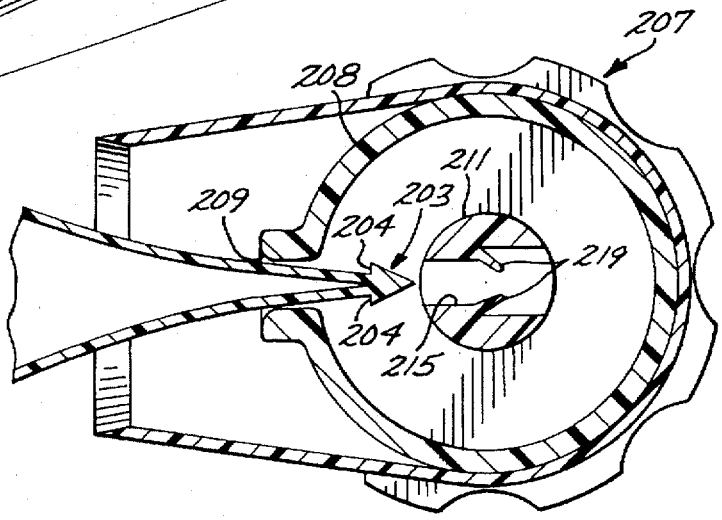
FIG. 15 is a longitudinal, partial sectional view, in enlarged scale, of the tube and dispenser apparatus shown in 1 but during the assembly stage.
Figure 16:
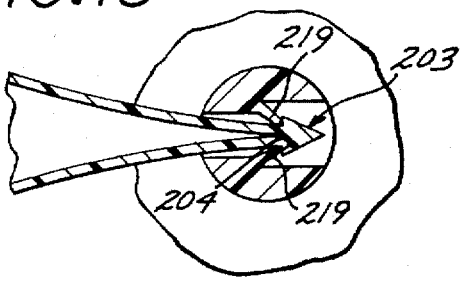
FIG. 16 is a partial view, similar to FIG. 15, but showing the tube and reel locked together.

The tube and dispenser apparatus shown in FIGS. 14–16 includes, generally, a tube, generally designated 201, formed at its closed end with an elongated tail configured with a transversely projecting wedge-shaped clasp, generally designated 203, defining, in cross section, an arrowhead shaped ridge 206 formed with rearwardly facing shoulder stops 240 receivable in the mouth 205 of a dispenser device, generally designated 207.

Referring to FIG. 15, the dispenser device 207 is similar to that shown in FIGS. 2 and 7 and described hereinabove and includes a cylindrical housing 208 formed with a forwardly facing, laterally projecting compressing slit 209 and mounting a laterally projecting reel core 211 configured with a laterally projecting, diametrical slot 215 which forms a path for the clasp wedge 203. Mounted at the opposite ends of the reel are hand wheels 202 and 204. The hand wheel 202 incorporates a brake in the form of a ratchet like that shown in FIG. 7. In another embodiment, a friction brake is incorporated to resist onreeling of the tube material wrapped on the reel. The reel core 211 is conveniently formed of polyurethane and includes in the slot 215 a pair of diametrically, oppositely disposed sets of inwardly directed resilient teeth 219 which angle away from the body of the tube 201 and are deflectable for passage therepast of the wedge 203 to assume the configuration shown in FIG. 16. It will be appreciated by those skilled in the art that, in this manner, during assembly, the reel core 211 can be clocked to align the slot 215 with the slit 209 and the tall, or closed end of the tube 201, inserted through the mouth 205 into the slit 209 and pushed thereinto to drive the clasp 203 into the slot 215 to deflect the teeth 219 away from one another to clear such clasp 203 to allow the stop surfaces 204 to be engaged behind the free tips of the respective teeth 219. It will be appreciated that, in some embodiments, only a single tooth may be incorporated on one side of the slot 215 to such that the clasp 203 clears that single tooth but with the free end of the tooth thus engaging behind one of the stop surfaces 204.

In other embodiments, a flexible tooth may be incorporated on the closed end of the tube 203 and a laterally projecting, rearwardly facing stop formed within the slot 215 such that the flexible tooth of the tube will be registered behind that stop to flex into position engaging the reel stop.

In still other embodiments, the teeth 219 themselves may be of relatively rigid construction and the clasp wedge 203 of compressible construction such that by driving such wedge between the teeth, or between one of the teeth and the side wall of the slot 215, the clasp 203 will be compressed in cross-section to allow it to pass beyond the tooth to expand and be engaged therebehind. Numerous other different configurations will be apparent to those skilled in the art from this disclosure wherein a compressible or resilient clasp and anchoring arrangement will be provided allowing for the snap engagement of the anchor and clasp elements relative to one another upon assembly.

Figure 17:
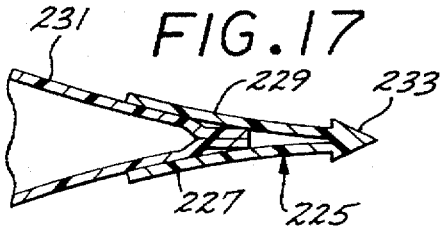
FIG. 17 is a partial detail modification of the tube and dispenser apparatus shown in FIG. 14 but in enlarged scale.

Referring to FIG. 17, it will be appreciated that in some embodiments a separate clasp fitting, generally designated 225, may be provided which is in the form of Y-shaped tabs 227 and 229 engaged on the opposite sides of the closed end 231 of a collapsible tube and configured on its free end with the clasp wedge 233. This wedge may be constructed of compressible material to, when driven between the rigid teeth constructed as shown in FIG. 16, be compressed to clear the space between such teeth to then flex outwardly to engage the stop shoulders 204 behind such teeth.

Figure 18:
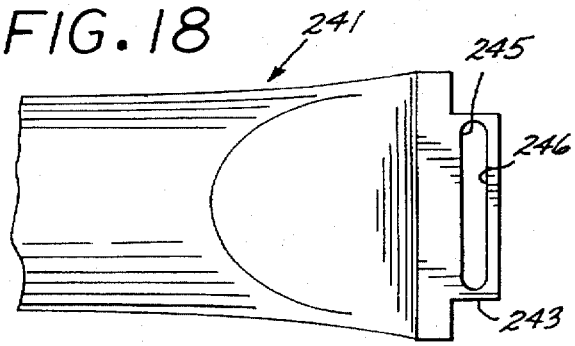
FIG. 18 is a top plan view of a tube incorporated in a still further embodiment of the tube and dispenser device of the present invention.
Figure 19:
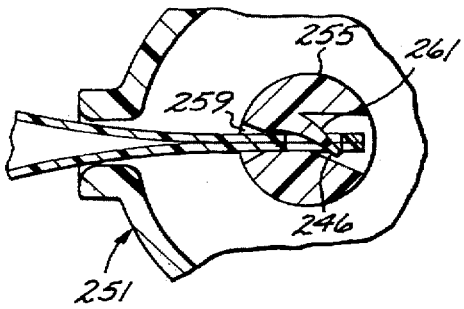
FIG. 19 is a longitudinal sectional view, in enlarged scale, of a dispenser device to be anchored to the tube shown in FIG. 18.

Referring to FIGS. 18 and 19, in a still further configuration, the collapsible tube, generally designated 241, may be formed with a projecting tail tab 243 configured with a transversely projecting slot or aperture 245.

In this construction, a dispenser device, generally designated 251, is provided with a reel 255 which includes a laterally projecting diametrical slot 259 having a resilient tooth 261 projecting laterally thereinto to, in its normal position, block the path through such slot. Then, during assembly, the closed end of the tube 241 may be inserted into the housing of the dispenser device 251 to drive the tab 243 into the slot 249 and deflect the tooth 261 to one side, allowing the aperture 245 to register with the tip thereof thereby allowing such tip to snap into the aperture 245 to thus act against the stop edge 246 formed by the back side of such aperture as shown in FIG. 19 to thus lock the tab 243 into position. Then, when the reel is rotated, the tab 243 will be wound on such reel to draw the closed end of the tube 241 progressively into the slit thus compressing the flowable material in the tube and pushing it toward the dispensing end thereof.

From the foregoing, it will be apparent that the method and apparatus of the present invention provides a convenient and economical means for fabricating a tube of flowable material with a dispenser permanently attached thereto and that the dispenser itself will be operable to conveniently wind the tube on the reel thereof and squeeze the flowable material from the dispensing end of the tube.

While several forms of the invention have been illustrated and described, it will also be apparent that various modifications may be made without departing from the spirit and scope of the invention.

What is claimed is:

1. Snapped together tube and dispenser apparatus for storing and selectively dispensing flowable contents, and comprising:

an elongated flexible tube body formed with a compressible peripheral wall radially expanded into a laterally outwardly distended storing orientation and having a selectively openable dispensing end and a flattened closed end formed with a catch;

a dispensing device including a hollow, laterally housing formed on one side with a narrowed compression slit for progressively receiving said body to compress the opposite lateral side of said peripheral wall together; and a laterally projecting rotatable reel in said housing, including an anchor configured to slidably receive said catch and operative upon receipt thereinto of said catch to latch thereto whereby during assembly said closed end of said tube may be slidably inserted in said slit to latchingly engage said catch with said anchor.

2. Snapped together tube and dispenser apparatus according to claim 1 wherein:

said housing is formed with a transversely elongated cylindrical barrel having oppositely disposed end walls configured with central bores; and said reel is in the form of a core constructed with a laterally elongated slot formed with at least one flexible tooth configured to be engaged by said closed end and to flex to allow said closed end to pass to engage said catch with said tooth.

3. Snapped together tube and dispenser apparatus according to claim 1 wherein:

said reel is formed with at least one resilient tooth projecting into said slot from one side thereof to terminate in an anchor tip; and said closed end includes a catch formed with a stop facing toward said tube to engage said anchor tip.

4. Snapped together tube and dispenser apparatus according to claim 3 wherein:

said catch includes an enlarged in cross section laterally projecting strip.

5. Snapped together tube and dispenser apparatus according to claim 3 wherein:

said closed end includes a laterally projecting aperture configured so one end thereof defines said catch stop.

6. Snapped together tube and dispenser apparatus according to claim 3 wherein:

said catch includes a wedge formed with an edge facing away from said tube.

7. Snapped together tube and dispenser apparatus according to claim 1 wherein:

said anchor includes flexible teeth projecting inwardly from the opposite sides of said slot.

8. Snapped together tube and dispenser apparatus according to claim 1 wherein:

said dispenser includes a brake interposed between said housing and reel to resist rotation of said reel in the unreeling direction.

9. Snapped together tube and dispenser apparatus comprising an elongated flexible tube body formed with an expandable peripheral wall distended to a storing orientation and compressed at one end into a laterally substantially flattened orientation defining a closed end;

a catch element on said closed end;

a dispensing device at said closed end including a cylindrical housing formed on one side with a narrowed compression slit for progressively receiving said body to progressively compress the opposite lateral side of said peripheral wall together, and a laterally projecting rotatable reel rotatably mounted in said housing and formed with an anchor element engaged with and permanently lock to said catch element.

10. Snapped together tube and dispenser apparatus as set forth in claim 9 wherein:

one of said elements is compressible to, upon being engaged by the other of said elements during assembly of said closed end to said reel, be compressed to clear space in said slot for passage therepast of the other of said elements.

11. Snapped together tube and dispenser apparatus as set forth in claim 9 wherein:

said catch element includes a catch surface facing said tube; and said anchor element includes a stop surface engageable with said catch surface.

12. Snapped together tube and dispenser apparatus as set forth in claim 11 wherein:

said reel is configured with a diametrical, laterally projecting slot, including flexible anchor teeth projecting inwardly from the opposite sides thereof and angling away from said tube; and said catch includes a stop surface disposed distal of said teeth from said tube.

13. A method of making a snapped together tube and dispenser apparatus for selectively dispensing storable contents, said method including the steps of:

selecting a collapsible tube of the type having a flexible peripheral wall capable of being compressed and expanded and having a selectively openable dispensing end and an open filling end;

filling said tube with a flowable material;

closing said tube and forming a flattened closed end;

forming a clasp element of a predetermined configuration on said closed end;

selecting a dispensing device of the type including a cylindrical hollow housing formed with a laterally projecting narrowed compression slit and a rotatable reel concentrically disposed in said housing and formed with an anchor element;

said elements being of the type cooperative upon engagement with one another to snap together in a latching position; and inserting said closed end through said slit and to engage said clasp element with said anchor element to latch said elements together.

14. The method set forth in claim 13 that includes:

the step of selecting said dispensing device to include a reel formed with a laterally projecting slot configured with a deflectable anchor tooth; and the step of inserting said closed end includes rotating said reel to align said slot with said slit and advancing said tube toward said dispenser to drive said closed end against said tooth to deflect said tooth and engage said clasp element therewith.

* * * * *